US010120315B2

(12) United States Patent
Kitabayashi

(10) Patent No.: US 10,120,315 B2
(45) Date of Patent: Nov. 6, 2018

(54) IMAGE FORMING APPARATUS

(71) Applicant: KYOCERA Document Solutions Inc., Osaka-shi, Osaka (JP)

(72) Inventor: Yuta Kitabayashi, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/497,877

(22) Filed: Apr. 26, 2017

(65) Prior Publication Data

US 2017/0315488 A1 Nov. 2, 2017

(30) Foreign Application Priority Data

Apr. 28, 2016 (JP) ..... 2016-090499

(51) Int. Cl.
*G03G 15/00* (2006.01)
*G03G 15/16* (2006.01)

(52) U.S. Cl.
CPC ..... *G03G 15/5054* (2013.01); *G03G 15/1675* (2013.01)

(58) Field of Classification Search
CPC ..... G03G 15/1675; G03G 15/1605; G03G 15/161; G03G 15/0189
See application file for complete search history.

(56) References Cited

U.S. PATENT DOCUMENTS

2012/0224873 A1* 9/2012 Aoki ..... G03G 15/161 399/66

FOREIGN PATENT DOCUMENTS

JP 2004062086 A 2/2004

* cited by examiner

*Primary Examiner* — Walter L Lindsay, Jr.
*Assistant Examiner* — Jessica L Eley
(74) *Attorney, Agent, or Firm* — Alleman Hall Creasman & Tuttle LLP

(57) ABSTRACT

A characteristic measuring portion measures current-voltage characteristics of a primary transfer member before a toner image for a first surface of a sheet is primarily transferred. A characteristic information storage portion stores characteristic information that indicates the current-voltage characteristics. A first transfer voltage determining portion determines a first transfer voltage based on a first target current value and the characteristic information. A second transfer voltage determining portion determines a second transfer voltage based on a second target current value and the characteristic information that was used when the first transfer voltage was determined, the second target current value being smaller than the first target current value. A voltage control portion applies the first and second transfer voltages to the primary transfer member by a constant-voltage method when the toner images for the first and second surfaces of the sheet are primarily transferred, respectively.

6 Claims, 5 Drawing Sheets

IMAGE FORMING APPARATUS

INCORPORATION BY REFERENCE

This application is based upon and claims the benefit of priority from the corresponding Japanese Patent Application No. 2016-090499 filed on Apr. 28, 2016, the entire contents of which are incorporated herein by reference.

BACKGROUND

The present disclosure relates to an image forming apparatus including a primary transfer member configured to primarily transfer a toner image from an image carrying member to an intermediate transfer member.

In an image forming apparatus including a primary transfer member configured to primarily transfer a toner image from an image carrying member to an intermediate transfer member, a predetermined transfer voltage may be applied to the primary transfer member by a constant-voltage control. In this type of image forming apparatus, if a resistance value of the intermediate transfer member changes due to the temperature, the current flowing through the primary transfer member may change, and this may cause a transfer failure and result in an image deterioration.

There is known an image forming apparatus in which, to prevent such an image deterioration, each time the temperature of the intermediate transfer member changes by more than or equal to a certain level, the print job is suspended, the voltage applied to the transfer member (the primary or secondary transfer member) is changed, a value of the current flowing through the transfer member after the voltage change is detected, and the transfer voltage to be applied to the transfer member is set again.

In addition, in a case of an image forming apparatus including a double-sided print mode, in the double-sided print mode, a toner image is secondarily transferred to a first surface of a sheet and the toner image is fixed to the sheet by a fixing portion, and another toner image is secondarily transferred and fixed to a second surface of the sheet.

SUMMARY

An image forming apparatus according to an aspect of the present disclosure includes an image carrying member, an intermediate transfer member, a primary transfer member, a characteristic measuring portion, a characteristic information storage portion, a first transfer voltage determining portion, a second transfer voltage determining portion, and a voltage control portion. A toner image formed on a surface of the image carrying member is primarily transferred to the intermediate transfer member. The primary transfer member is disposed to face the image carrying member across the intermediate transfer member and primarily transfers the toner image from the image carrying member to the intermediate transfer member. The characteristic measuring portion measures current-voltage characteristics of the primary transfer member before a toner image for a first surface of a sheet is primarily transferred. The characteristic information storage portion stores characteristic information that indicates the current-voltage characteristics measured by the characteristic measuring portion. The first transfer voltage determining portion determines, based on a predetermined first target current value and the characteristic information, a first transfer voltage that is applied to the primary transfer member when the toner image for the first surface of the sheet is primarily transferred. The second transfer voltage determining portion determines, based on a predetermined second target current value and the characteristic information that was used when the first transfer voltage was determined, a second transfer voltage that is applied to the primary transfer member when a toner image for a second surface of the sheet is primarily transferred, wherein the second target current value is smaller than the first target current value. The voltage control portion applies the first transfer voltage to the primary transfer member by a constant-voltage method when the toner image for the first surface of the sheet is primarily transferred, and applies the second transfer voltage to the primary transfer member by the constant-voltage method when the toner image for the second surface of the sheet is primarily transferred.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

The following describes an embodiment of the present disclosure with reference to the accompanying drawings for the understanding of the present disclosure. It should be noted that the following embodiment is an example of a specific embodiment of the present disclosure and should not limit the technical scope of the present disclosure.

Figure 1:
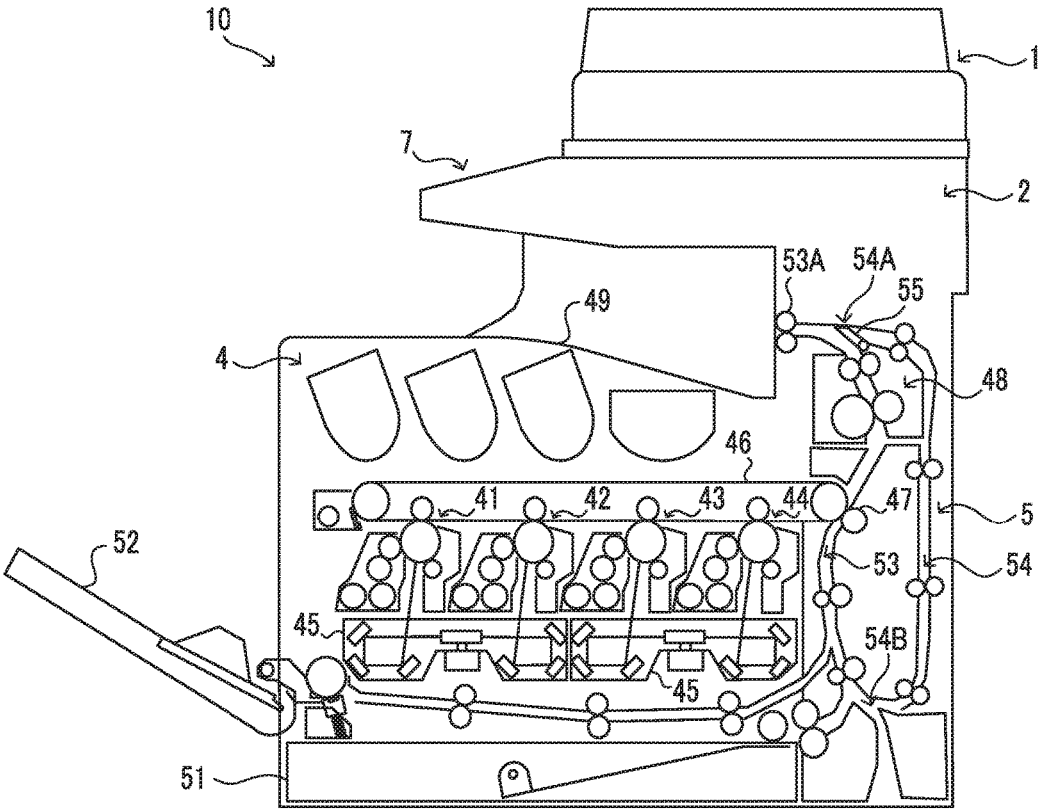
FIG. 1 is a diagram showing an overall configuration of an image forming apparatus according to an embodiment of the present disclosure.
Figure 2:
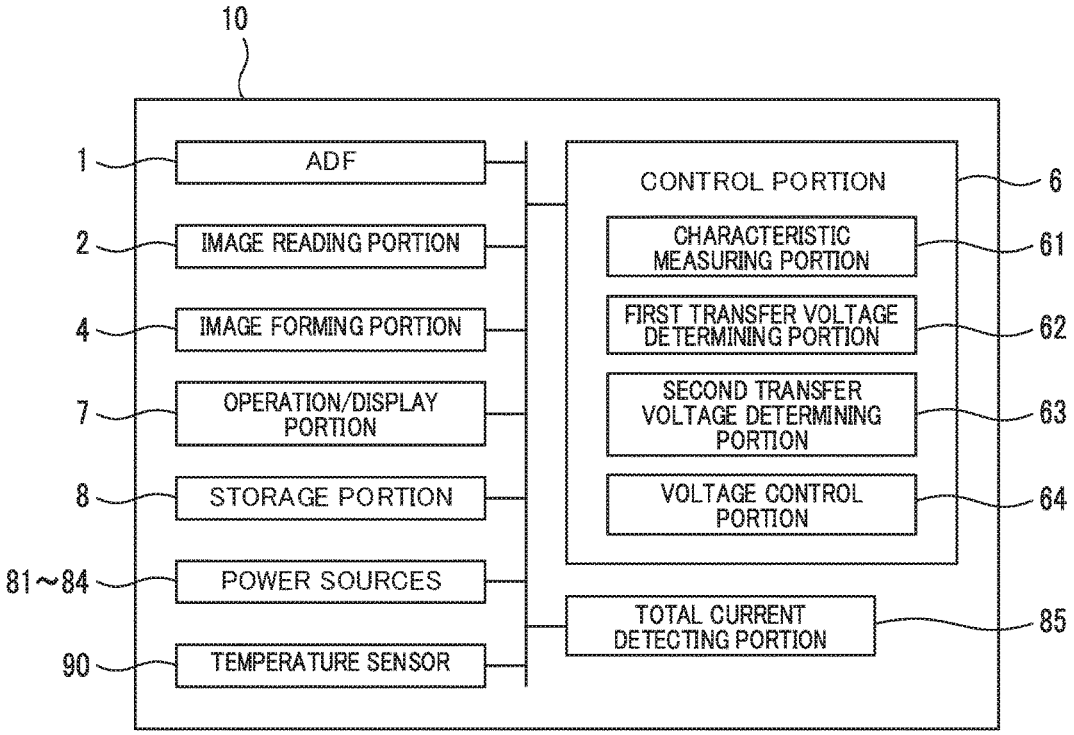
FIG. 2 is a block diagram showing a system configuration of the image forming apparatus according to the embodiment of the present disclosure.
Figure 3:
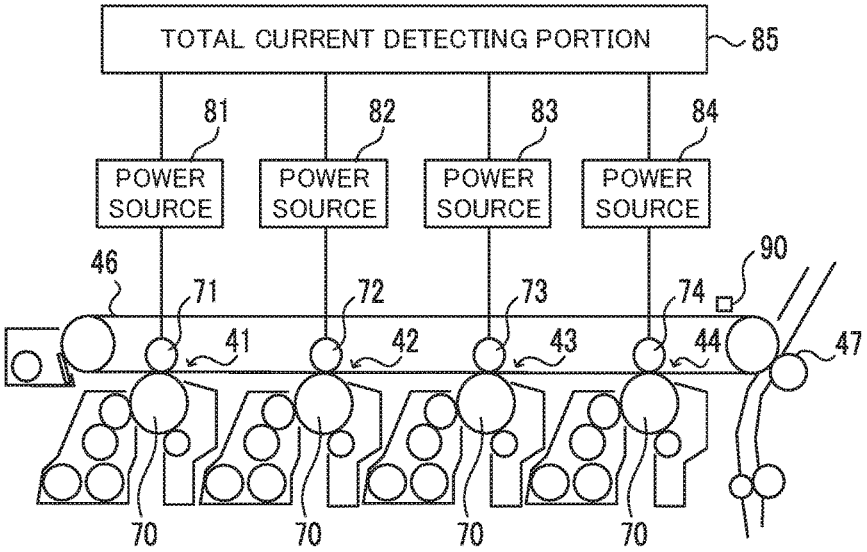
FIG. 3 is a diagram showing a partial configuration of the image forming apparatus according to the embodiment of the present disclosure.

First, a description is given of an outline configuration of an image forming apparatus 10 according to an embodiment of the present disclosure, with reference to FIG. 1 to FIG. 3.

As shown in FIG. 1 to FIG. 3, the image forming apparatus 10 includes an ADF 1, an image reading portion 2, an image forming portion 4, a sheet conveying portion 5, a control portion 6, an operation/display portion 7, and a storage portion 8 (an example of the characteristic information storage portion of the present disclosure). The image forming apparatus 10 is a multifunction peripheral having a plurality of functions such as a scan function for reading image data from a document sheet, a print function for forming an image based on image data, a facsimile function, and a copy function. It is noted that the present disclosure is applicable to image forming apparatuses such as a scanner device, a facsimile device, and a copier.

The ADF 1 feeds one by one a plurality of document sheets placed on a document sheet placing portion (not shown). The image reading portion 2 reads image data from a document sheet conveyed by the ADF 1, or from a document sheet placed on a contact glass (not shown).

The image forming portion 4 is configured to execute an image forming process (printing process) of forming a color or monochrome image by the electrophotographic method based on image data read by the image reading portion 2, or image data input from an external information processing apparatus such as a personal computer.

As shown in FIG. 1, the image forming portion 4 includes a plurality of image forming units 41 to 44, a laser scanning device 45, an intermediate transfer belt 46 (an example of the intermediate transfer member of the present disclosure), a secondary transfer roller 47, a fixing device 48, and a sheet discharge tray 49. The image forming unit 41 corresponds to C (cyan), the image forming unit 42 corresponds to M (magenta), the image forming unit 43 corresponds to Y (yellow), and the image forming unit 44 corresponds to K (black). The image forming units 41 to 44 form images based on the electrophotographic method. Each of the image forming units 41 to 44 includes a photoconductor drum 70 (an example of the image carrying member of the present disclosure), a charging device, a developing device, a primary transfer roller, and a cleaning device.

The laser scanning device 45 forms electrostatic latent images on the surfaces of the photoconductor drums 70 based on the image data by irradiating laser beams on the photoconductor drums 70 based on the image data. The electrostatic latent images are developed by the developing device such that toner images of the respective colors are formed on the surfaces of the photoconductor drums 70. Primary transfer rollers 71 to 74 (an example of the primary transfer member of the present disclosure) are disposed at positions that respectively face the photoconductor drums 70 across the intermediate transfer belt 46. The primary transfer rollers 71 to 74 primarily transfer the toner images from the surfaces of the photoconductor drums 70 to the intermediate transfer belt 46. The toner images primarily transferred to the intermediate transfer belt 46 are secondarily transferred by the secondary transfer roller 47 to a sheet supplied from the sheet conveying portion 5. Subsequently, the toner images transferred to the sheet are fused and fixed to the sheet by the fixing device 48, thereby a color image is formed on the sheet, and the sheet is discharged onto the sheet discharge tray 49.

As shown in FIG. 1, the sheet conveying portion 5 includes a sheet supply cassette 51, a manual feed tray 52, a first conveyance path 53, a second conveyance path 54, and a switch member 55. Sheets are placed on the sheet supply cassette 51 or the manual feed tray 52. The sheet conveying portion 5 conveys one by one a plurality of sheets placed on the sheet supply cassette 51 or the manual feed tray 52.

In the first conveyance path 53, a plurality of rollers including a pick-up roller, a registration roller, and a discharge roller 53A are provided. In the sheet conveying portion 5, the rollers are rotated by a driving force transmitted from a motor (not shown), thereby a sheet is conveyed from the sheet supply cassette 51 or the manual feed tray 52 to the sheet discharge tray 49 via the secondary transfer roller 47 and the fixing device 48.

The second conveyance path 54 connects a first junction portion 54A and a second junction portion 54B, the first junction portion 54A being located on the downstream side of the fixing device 48 in the first conveyance path 53, the second junction portion 54B being located on the upstream side of the registration roller in the first conveyance path 53. In the second conveyance path 54, a plurality of rollers are provided to convey the sheets. The switch member 55 is provided at the first junction portion 54A, and is configured to switch the state of the first junction portion 54A between a first state and a second state, wherein in the first state, the first conveyance path 53 is opened and the second conveyance path 54 is closed, and in the second state, the first conveyance path 53 is closed and the second conveyance path 54 is opened.

In the image forming apparatus 10, the image forming portion 4 can form images on both sides of a sheet conveyed by the sheet conveying portion 5. In a double-sided print mode in which printing is performed on both sides of a sheet, at a timing when a rear end of a sheet on whose first surface an image has been formed by the image forming portion 4, has passed the first junction portion 54A, the control portion 6 switches the state of the first junction portion 54A from the first state to the second state by causing the switch member 55 to operate. On the other hand, the control portion 6 causes the discharge roller 53A to rotate reversely after the switch member 55 starts to operate and the second conveyance path 54 is opened. This allows the sheet whose first and second surfaces have been turned upside down after passing through the second conveyance path 54 and the second junction portion 54B, to be sent into the first conveyance path 53 again. This image forming portion 4 then forms an image on the second surface of the sheet.

The control portion 6 includes control equipment such as CPU, ROM, and RAM. The CPU is a processor that executes various calculation processes. The ROM is a non-volatile storage portion in which various information such as control programs for causing the CPU to execute various processes are stored in advance. The RAM is a volatile storage portion that is used as a temporary storage memory (working area) for the various processes executed by the CPU. The control portion 6 causes the CPU to execute various control programs stored in the ROM in advance. This allows the control portion 6 to control the image forming apparatus 10 comprehensively. It is noted that the control portion 6 may be composed of an electronic circuit such as an integrated circuit (ASIC), or may be a control portion provided independent of a main control portion that controls the image forming apparatus 10 comprehensively.

The operation/display portion 7 includes a display portion and an operation portion. The display portion includes, for example, a liquid crystal display and displays various types of information in response to control instructions from the control portion 6. The operation portion includes operation keys or a touch panel for inputting various types of information to the control portion 6 in response to operations of the user.

The storage portion 8 is a storage device such as SSD (Solid State Drive) or HDD (Hard Disk Drive). Various types of information including the characteristic information that is described below are stored in the storage portion 8.

As shown in FIG. 3, the primary transfer rollers 71 to 74 are connected to power sources 81 to 84 that apply voltages to the primary transfer rollers 71 to 74 individually. The power sources 81 to 84 are controlled by the control portion 6 such that a predetermined transfer voltage is applied to the primary transfer rollers 71 to 74 (constant-voltage control). This allows an electric field to be generated between the intermediate transfer belt 46 and each of the photoconductor drums 70, and toner charged to have a predetermined polarity is primarily transferred from the surface of each photoconductor drum 70 to the intermediate transfer belt 46.

Meanwhile, in a case where, as in the present embodiment, a predetermined transfer voltage is applied to the primary transfer rollers 71 to 74 by the constant-voltage control, if a resistance value of the intermediate transfer belt 46 changes due to the temperature, the current flowing through the primary transfer rollers 71 to 74 may change, which may cause a transfer failure and result in an image deterioration. As one example of the method to prevent such an image deterioration, each time the temperature of the intermediate transfer belt 46 changes by more than or equal to a certain level, the print job is suspended, the voltage applied to the primary transfer rollers 71 to 74 is changed, a value of the current flowing through the primary transfer rollers 71 to 74 after the voltage change is detected, and the transfer voltage to be applied to the primary transfer rollers 71 to 74 is set again.

On the other hand, when toner images are transferred to the second surface of the sheet in the double-sided print mode, the sheet has a higher resistance than when transferred to the first surface since moisture content in the sheet has been reduced due to the heating by the fixing device 48. As a result, a potential difference between the sheet and the toner becomes large during the secondary transfer to the second surface, and a transfer failure due to a discharge phenomenon may become easy to occur. To prevent the occurrence of such a transfer failure, it is effective to apply a transfer voltage that is lower than that applied when toner images for the first surface are primarily transferred, to the primary transfer rollers 71 to 74 when toner images for the second surface are primarily transferred.

However, it takes time to detect a value of the current flowing through the primary transfer rollers 71 to 74 after changing the voltage applied to the primary transfer rollers 71 to 74. Accordingly, in the double-sided print mode, if the print job is suspended, values of the currents flowing through the primary transfer rollers 71 to 74 after changing the voltages applied to the primary transfer rollers 71 to 74 are detected, and the transfer voltage to be applied to the primary transfer rollers 71 to 74 when toner images are transferred to the second surface of a sheet is set again, the productivity is decreased.

In view of the above-described problem, in the image forming apparatus 10 of the present embodiment, the control portion 6 sets again the transfer voltage to be applied to the primary transfer rollers 71 to 74 when toner images are transferred to the second surface of a sheet in the double-sided print mode, by the method described in the following. This makes the image forming apparatus 10 of the present embodiment to suppress the occurrence of a transfer failure in the double-sided print mode, while suppressing the decrease of the productivity.

The control portion 6 includes a characteristic measuring portion 61, a first transfer voltage determining portion 62, a second transfer voltage determining portion 63, and a voltage control portion 64. It is noted that the control portion 6 functions as processing portions as it executes various processes in accordance with the control programs. Here, the control portion 6 may include an electronic circuit that realizes a part or all of a plurality of processing functions of the processing portions.

The characteristic measuring portion 61 is configured to measure current-voltage characteristics of the primary transfer rollers 71 to 74 before toner images for the first surface of a sheet are primarily transferred. Specifically, the characteristic measuring portion 61 measures the current-voltage characteristics of each of the primary transfer rollers 71 to 74 individually, based on the currents detected when a plurality of different voltages are applied from a corresponding one of the power sources 81 to 84 to a corresponding one of the primary transfer rollers 71 to 74 in sequence by the constant voltage method. A plurality of pieces of characteristic information that respectively indicate the current-voltage characteristics of the primary transfer rollers 71 to 74 are generated based on the measurement results of the characteristic measuring portion 61 and are stored in the storage portion 8 or the like.

It is noted that "before toner images for the first surface of a sheet are primarily transferred" refers to any of the following time periods.

A time period from turning on of the power source (main power source) of the image forming apparatus 10 to immediately before an initial primary transfer.

A time period from an end of the last primary transfer in the last print job to immediately before an initial primary transfer in the present print job.

In a single-sided print job for printing a plurality of copies, a time period from an end of the primary transfer of toner images for the last sheet (first surface) to immediately before the primary transfer of toner images for the present sheet (first surface).

In a double-sided print job for printing a plurality of copies, a time period from an end of the primary transfer of toner images for the second surface of the last sheet to immediately before the primary transfer of toner images for the first surface of the present sheet.

It is noted that the characteristic measuring portion 61 may measure the current-voltage characteristics of the primary transfer rollers 71 to 74 before toner images for the first surface of the sheet are primarily transferred if a predetermined measurement condition is satisfied. The measurement condition is, for example, that an ambient temperature of the intermediate transfer belt 46 has changed by more than or equal to a certain level since the last generation of the characteristic information (namely, from the time point when the current-voltage characteristics were last measured).

The first transfer voltage determining portion 62 determines, based on a predetermined target current value (hereinafter referred to as a "first target current value") and the characteristic information, transfer voltages (hereinafter referred to as "first transfer voltages") that are applied to the primary transfer rollers 71 to 74 when toner images for the first surface of a sheet are primarily transferred. The second transfer voltage determining portion 63 determines, based on: a predetermined target current value (hereinafter referred to as a "second target current value") that is smaller than the first target current value; and the characteristic information that was used when the first transfer voltages were determined, transfer voltages (hereinafter referred to as "second transfer voltages") that are applied to the primary transfer rollers 71 to 74 when toner images for the second surface of the sheet are primarily transferred. That is, in the present embodiment, the second transfer voltages are determined based on the characteristic information that was used when the first transfer voltages were determined. With this configuration, there is no need for the characteristic measuring portion 61 to perform a measurement process in order to determine the second transfer voltages. This makes it possible to suppress the occurrence of a transfer failure in the double-sided print mode, while suppressing the decrease of the productivity.

The voltage control portion 64 applies the first transfer voltages determined by the first transfer voltage determining portion 62 to the primary transfer rollers 71 to 74 by the constant-voltage method when toner images for the first surface of a sheet are primarily transferred. In addition, the voltage control portion 64 applies the second transfer voltages determined by the second transfer voltage determining portion 63 to the primary transfer rollers 71 to 74 by the constant-voltage method when toner images for the second surface of a sheet are primarily transferred.

A total current detecting portion 85 detects a total current by totaling the output currents of the power sources 81 to 84. It is noted that the configuration for detecting the total current by totaling the output currents of the power sources 81 to 84 can be realized by a lower cost than a configuration for detecting the output currents of the power sources 81 to 84 concurrently and individually. However, when the output currents of the power sources 81 to 84 are not detected concurrently and individually, it requires more time to measure the current-voltage characteristics of the primary transfer rollers 71 to 74. Specifically, the characteristic measuring portion 61 measures the current-voltage characteristics of the primary transfer rollers 71 to 74 in sequence based on the total current detected by the total current detecting portion 85 when the output voltage of each of the power sources 81 to 84 is changed in a predetermined pattern.

It is noted that as described above, in the present embodiment, the second transfer voltages are determined based on the characteristic information that was used when the first transfer voltages were determined. However, when the ambient temperature of the intermediate transfer belt 46 changes and the resistance value of the intermediate transfer belt 46 changes, the current-voltage characteristics of the primary transfer rollers 71 to 74 change accordingly. As a result, in a case where the ambient temperature of the intermediate transfer belt 46 changes, if the second transfer voltages are determined based on the characteristic information that was used when the first transfer voltages were determined, the second transfer voltages may deviate from appropriate values. In view of this, in the present embodiment, the control portion 6 monitors the temperature detected by a temperature sensor 90 (an example of the sensor of the present disclosure) disposed in the periphery of the intermediate transfer belt 46. In addition, the second transfer voltage determining portion 63 corrects the characteristic information that was used when the first transfer voltages were determined, as necessary based on the detection result of the temperature sensor 90, and determines the second transfer voltages based on the characteristic information after the correction. With this configuration, even if the ambient temperature of the intermediate transfer belt 46 changes, there is no need for the characteristic measuring portion 61 to perform a measurement process to determine the second transfer voltages. This makes it possible to suppress the occurrence of a transfer failure in the double-sided print mode, while suppressing the decrease of the productivity.

In particular, in the present embodiment, the intermediate transfer belt 46 contains an ion-conductive material, and the primary transfer rollers 71 to 74 contain conductive carbon. In addition, the resistance value of the intermediate transfer belt 46 is larger than the resistance value of the primary transfer rollers 71 to 74. That is, in the present embodiment, the current-voltage characteristics of each of the primary transfer rollers 71 to 74 measured by the characteristic measuring portion 61 are largely dependent on the intermediate transfer belt 46. As a result, it is possible to accurately correct the characteristic information in such a way as to reflect the change of the ambient temperature of the intermediate transfer belt 46.

In the following, an example of the procedure of the transfer voltage control process executed by the control portion 6 is described with reference to FIG. 4. Here, steps S1, S2, . . . represent numbers assigned to the processing procedures (steps) executed by the control portion 6. It is noted that, for example, the transfer voltage control process is started when the image forming apparatus 10 is powered on, and is ended thereafter when the image forming apparatus 10 is powered off.

<Step S1>

First, in step S1, the control portion 6 determines whether or not a printing process (print job) has been started. When it is determined that the printing process has been started (S1: Yes), the process moves to step S2. On the other hand, when it is determined that the printing process has not been started (S1: No), the process of step S1 is repeated until it is determined that the printing process has been started.

<Step S2>

In step S2, the control portion 6 determines whether or not the transfer process is performed on the first surface of the sheet. When it is determined that the transfer process is performed on the first surface of the sheet (S2: Yes), the process moves to step S3. On the other hand, when it is determined that the transfer process is performed on the second surface of the sheet (S2: No), the process moves to step S9. It is noted that the case where it is determined in step S2 that the transfer process is performed on the first surface of the sheet, includes a case where the transfer process is performed on the first surface of the sheet in the double-sided print mode, and a case where the transfer process is performed on (the first surface of) the sheet in the single-sided print mode.

<Step S3>

In step S3, the control portion 6 determines, based on the temperature detected by the temperature sensor 90, whether or not the detected temperature has changed by more than or equal to a certain level (for example, five degrees Celsius or more) since the last generation of the characteristic information. It is noted that the temperature detected when the characteristic information was generated last is stored in the storage portion 8 or the like together with the characteristic information. When it is determined that the detected temperature has changed by more than or equal to the certain level (S3: Yes), the process moves to step S4. It is noted that the process also moves to step S4 when an initial printing process is performed after the image forming apparatus 10 is powered on. On the other hand, when it is determined that the detected temperature has not changed by more than or equal to the certain level (S3: No), the process moves to step S5.

<Step S4>

Figure 5:
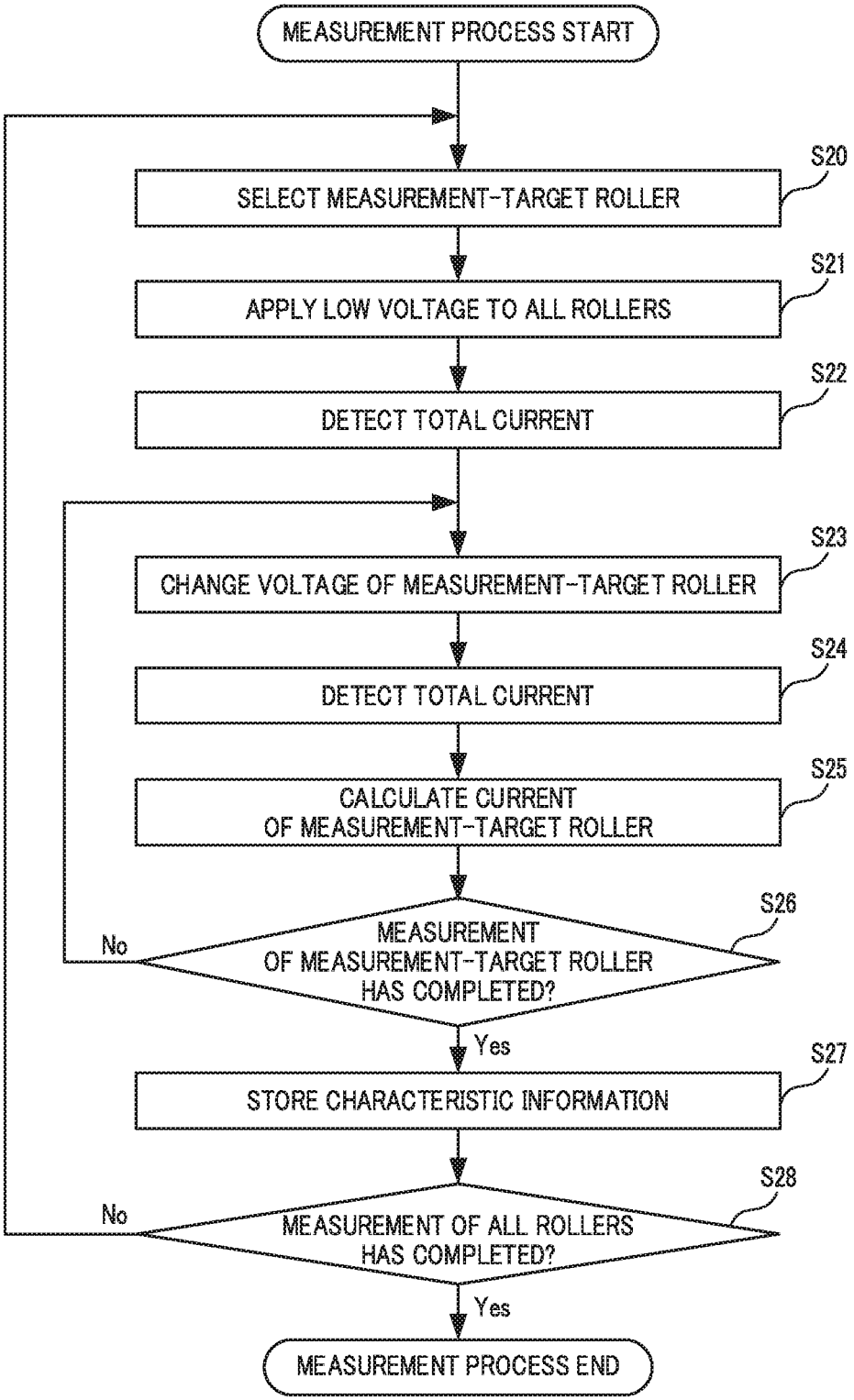
FIG. 5 is a flowchart showing an example of a procedure of a measurement process executed by the image forming apparatus according to the embodiment of the present disclosure.

In step S4, the control portion 6 executes a measurement process. In the following, an example of the procedure of the measurement process is described with reference to the flowchart of FIG. 5.

<Step S20>

When the measurement process is started, in step S20, the control portion 6 selects a measurement-target primary transfer roller (hereinafter referred to as a "measurement-target roller") from among the primary transfer rollers 71 to 74. For example, the control portion 6 selects a measurement target from the primary transfer rollers 71 to 74 in a predetermined order.

<Step S21>

In step S21, the control portion 6 performs the constant-voltage control on the power sources 81 to 84 and applies a predetermined low voltage (for example, 100V) to all of the primary transfer rollers 71 to 74 (hereinafter referred to as "all rollers"). The low voltage is set to a voltage that allows the current flowing through the primary transfer rollers 71 to 74 to be 0 (zero) or substantially 0 (zero).

<Step S22>

In step S22, the control portion 6 causes the total current detecting portion 85 to detect a total current by totaling the output currents of the power sources 81 to 84.

<Step S23>

In step S23, the control portion 6 changes only a voltage of, among the power sources 81 to 84, a power source that corresponds to the measurement-target roller. For example, the control portion 6 changes the voltage of the power source that corresponds to the measurement-target roller, to a voltage selected from predetermined voltages (for example, 900V, 1200V, and 1500V) in order.

<Step S24>

In step S24, the control portion 6 causes the total current detecting portion 85 to detect the total current by totaling the output currents of the power sources 81 to 84.

<Step S25>

In step S25, the control portion 6 calculates a current flowing through the measurement-target roller based on a difference between the total current detected in the step S22 and the total current detected in the step S24, and the voltage applied to the measurement-target roller (the voltage changed in the step 23). This value calculated here represents a current that flows through the measurement-target roller when the voltage changed in the step 23 is applied to the measurement-target roller.

<Step S26>

In step S26, the control portion 6 determines whether or not the measurement of the measurement-target roller has completed. For example, the control portion 6 determines that the measurement of the measurement-target roller has completed, when all of the currents that respectively flow through the measurement-target roller when predetermined three voltages (for example, 900V, 1200V, and 1500V) are applied to the measurement-target roller, have been calculated. When it is determined that the measurement of the measurement-target roller has completed (S26: Yes), the process moves to step S27. On the other hand, when it is determined that the measurement of the measurement-target roller has not completed (S26: No), the process returns to step S23.

<Step S27>

Figure 6:
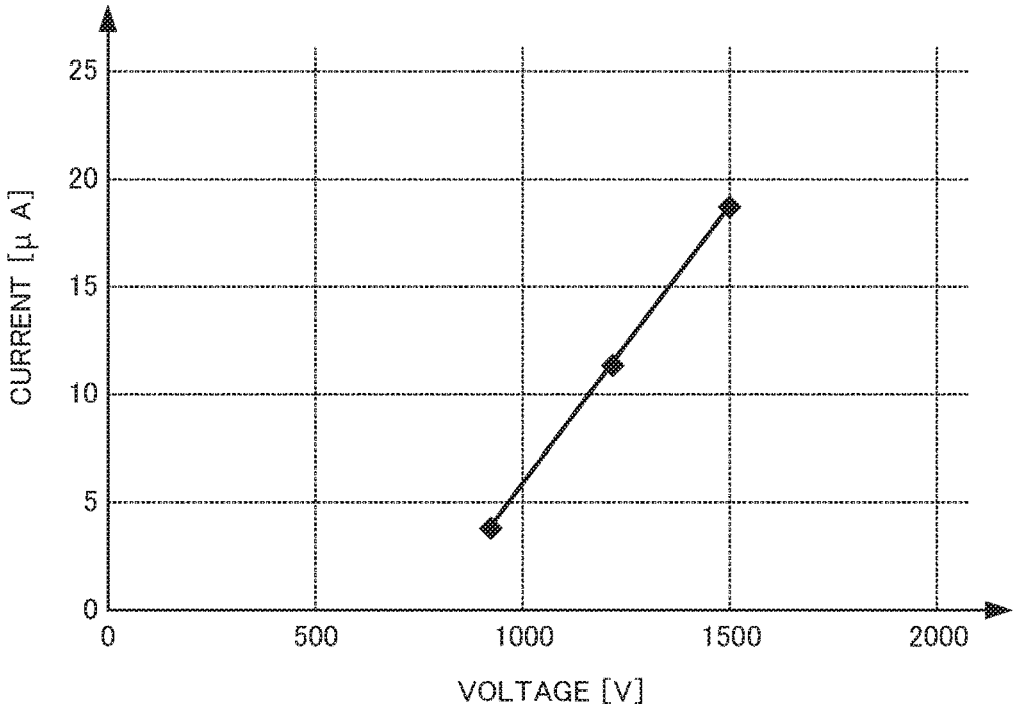
FIG. 6 is a diagram showing an example of characteristic information used in the image forming apparatus according to the embodiment of the present disclosure.

In step S27, the control portion 6 stores the characteristic information in the storage portion 8 or the like, wherein the characteristic information indicates the current-voltage characteristics of the measurement-target roller and is obtained based on the measurement results of the steps S21 to S26. For example, the control portion 6 obtains, based on the measurement results of the steps S21 to S26, a function ($y=0.025x-18.333$, for example) that represents an approximate straight line as shown in FIG. 6 (or an approximate curve), and stores the function in the storage portion 8 or the like as the characteristic information. Here, the control portion 6 also stores the temperature detected by the temperature sensor 90 at this point in time, in the storage portion 8 or the like. It is noted that in the example shown in FIG. 6, an approximate straight line is obtained based on the measurement results of the case where the three voltages 900V, 1200V, and 1500V are applied to the measurement-target roller. However, the present disclosure is not limited to this, but an approximate straight line may be obtained based on the measurement results of a case where two voltages or four or more voltages are applied to the measurement-target roller.

<Step S28>

In step S28, the control portion 6 determines whether or not the measurement of all of the primary transfer rollers 71 to 74 has completed. When it is determined that the measurement of all rollers has completed (S28: Yes), the measurement process ends, and the process moves to step S5 in FIG. 4. On the other hand, when it is determined that the measurement of all rollers has not completed (S28: No), the process returns to step S20.

As a result of the measurement process described above, the plurality of pieces of characteristic information that respectively correspond to the primary transfer rollers 71 to 74 are stored in the storage portion 8 or the like.

<Step S5>

Figure 4:
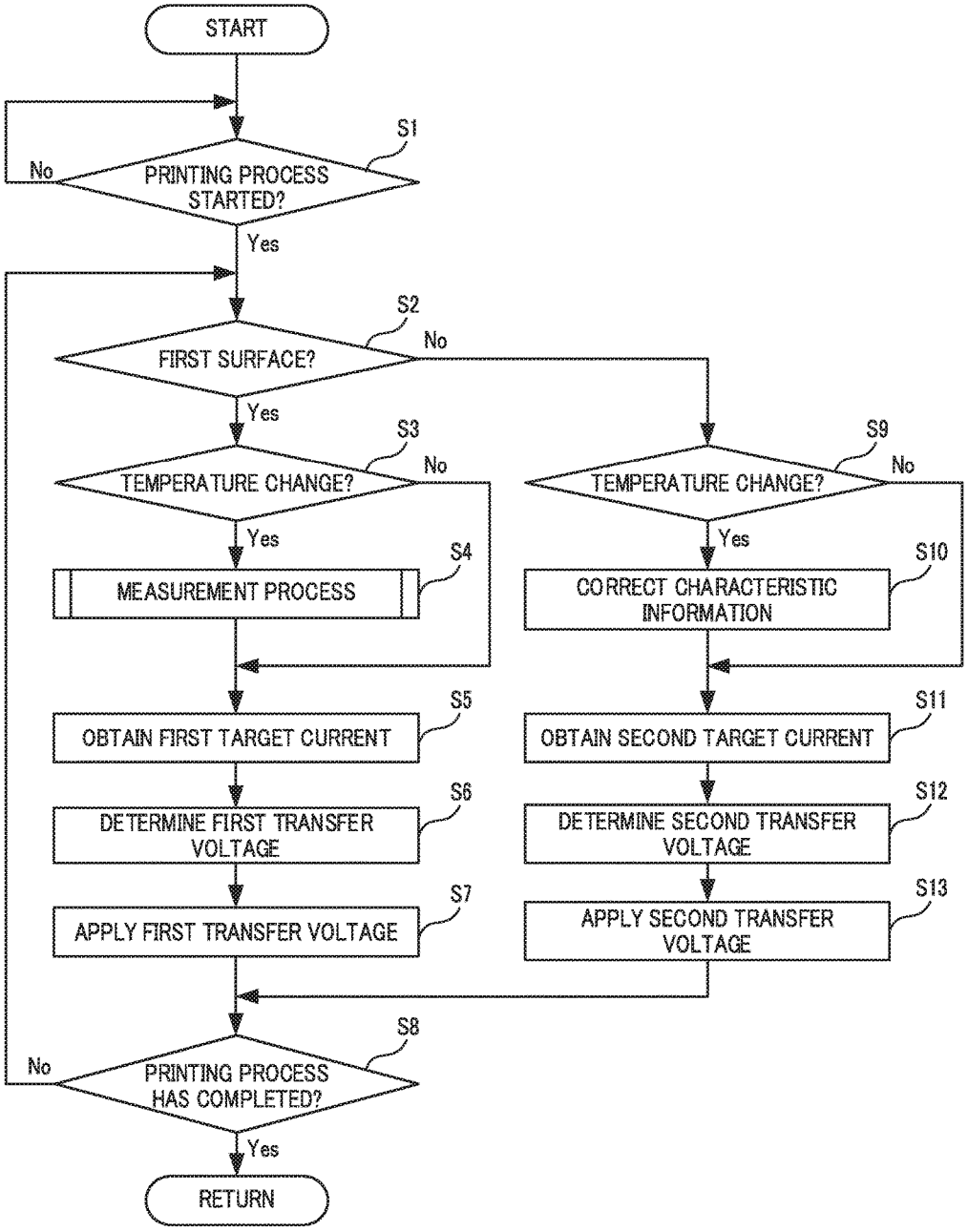
FIG. 4 is a flowchart showing an example of a procedure of a transfer voltage control process executed by the image forming apparatus according to the embodiment of the present disclosure.

In step S5 shown in FIG. 4, the control portion 6 obtains the first target current value. For example, the control portion 6 obtains the first target current value from the target current value table for the first surface stored in advance in the ROM. It is noted that the target current value table stores a plurality of first target current values, for example, in correspondence with a plurality of conditions such as sheet types, environment temperatures and the like, and the control portion 6 obtains, from the target current value table, a first target current value that corresponds to the present conditions.

<Step S6>

In step S6, the control portion 6 determines the first transfer voltages that are applied to the primary transfer rollers 71 to 74, based on the first target current value obtained in the step S5, and the characteristic information corresponding to the primary transfer rollers 71 to 74 stored in the storage portion 8 or the like. For example, when the characteristic information is function $y=0.025x-18.333$ (x represents voltage [V], and y represents current [μA]), and the first target current value is 15 μA, the first transfer voltage is determined as 1333 V.

<Step S7>

In step S7, the control portion 6 performs the constant-voltage control on the power sources 81 to 84, and applies the first transfer voltages determined in the step S6 to the primary transfer rollers 71 to 74, respectively. In this state, the toner images for the first surface are primarily transferred to the intermediate transfer belt 46.

<Step S8>

In step S8, the control portion 6 determines whether or not the printing process (print job) has completed. When it is determined that the printing process has completed, the process returns to step S1. On the other hand, when it is determined that the printing process has not completed, the process returns to step S2.

<Step S9>

In step S9, the control portion 6 determines, based on the temperature detected by the temperature sensor 90, whether or not the detected temperature has changed by more than or equal to a certain level (for example, five degrees Celsius or more) since the last generation of the characteristic information. It is noted that the temperature detected when the characteristic information was generated last is stored in the storage portion 8 or the like together with the characteristic information. When it is determined that the detected temperature has changed by more than or equal to a certain level (S9: Yes), the process moves to step S10. On the other hand, when it is determined that the detected temperature has not changed by more than or equal to a certain level (S9: No), the process moves to step S11.

<Step S10>

Figure 7:
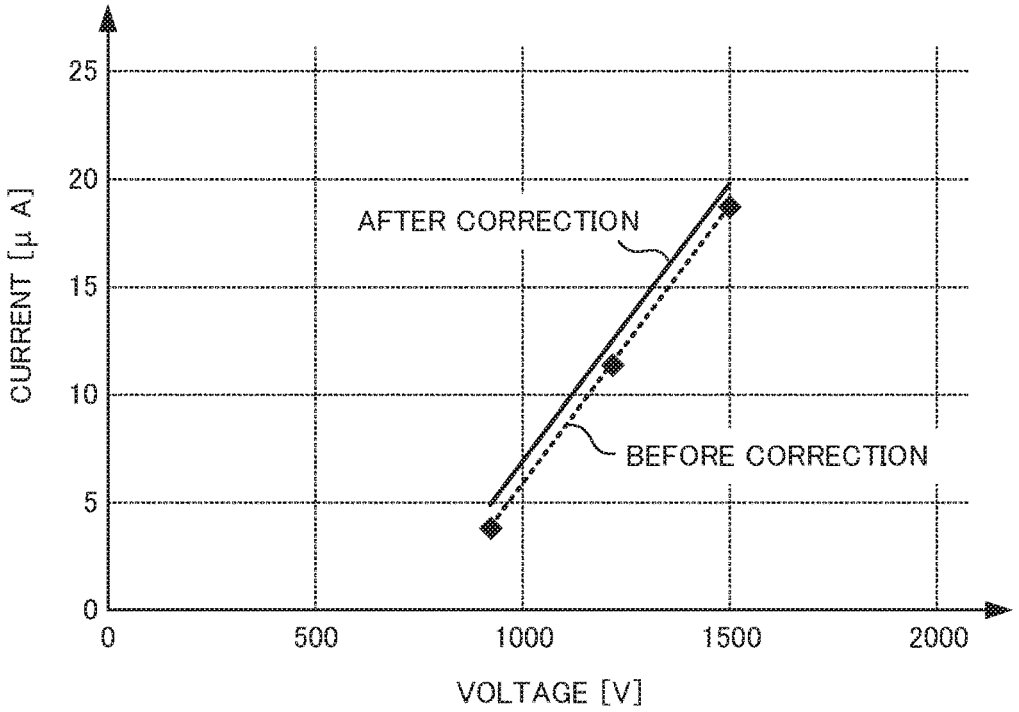
FIG. 7 is a diagram showing an example of the characteristic information after correction used in the image forming apparatus according to the embodiment of the present disclosure.

In step S10, the control portion 6 corrects the characteristic information stored in the storage portion 8 or the like. For example, the control portion 6 corrects the characteristic information based on the variation of the detected temperature since when the characteristic information was last generated. For example, when each piece of the characteristic information is stored in the storage portion 8 or the like as a function (a linear function, a quadratic function, or the like), the control portion 6 may correct the slice of the function based on the variation of the detected temperature since when the characteristic information was last generated, as shown in FIG. 7. For example, when the function before correction is $y=0.025x-18.333$, the function after correction may be $y=0.025x-17.333$.

<Step S11>

In step S11, the control portion 6 obtains the second target current value. For example, the control portion 6 obtains the second target current value from the target current value table for the second surface stored in advance in the ROM. It is noted that the target current value table stores a plurality of second target current values in correspondence with a plurality of conditions such as sheet types, environment temperatures and the like, and the control portion 6 obtains, from the target current value table, a second target current value that corresponds to the present conditions. It is noted that when sheet types, environment temperatures and the like are the same, the second target current value is set to be smaller than the first target current value. This makes it possible to suppress the occurrence of a transfer failure due to a discharge phenomenon when toner images are transferred to the second surface of the sheet.

<Step S12>

In step S12, the control portion 6 determines the second transfer voltages that are applied to the primary transfer rollers 71 to 74, based on the second target current value obtained in the step S11, and the characteristic information corresponding to the primary transfer rollers 71 to 74 stored in the storage portion 8 or the like (namely, the characteristic information that was used to determine the first transfer voltages). For example, when the characteristic information is function $y=0.025x-18.333$ (x represents voltage [V], and y represents current [μA]), and the second target current value is 10 μA, the second transfer voltage is determined as 1133 V. In addition, when the characteristic information is function $y=0.025x-17.333$ (x represents voltage [V], and y represents current [μA]), and the second target current value is 10 μA, the second transfer voltage is determined as 1093 V.

<Step S13>

In step S13, the control portion 6 performs the constant-voltage control on the power sources 81 to 84, and applies the second transfer voltages determined in the step S12 to the primary transfer rollers 71 to 74, respectively. In this state, the toner images for the second surface are primarily transferred to the intermediate transfer belt 46.

It is noted that the processes of the steps S4 and S20 to S28 are executed by the characteristic measuring portion 61 of the control portion 6. The processes of the steps S5 and S6 are executed by the first transfer voltage determining portion 62 of the control portion 6. The processes of the steps S10 to S12 are executed by the second transfer voltage determining portion 63 of the control portion 6. The processes of the steps S7 and S13 are executed by the voltage control portion 64 of the control portion 6.

It is noted that in the present embodiment, the characteristic information is corrected based on the change in the temperature detected by the temperature sensor 90. However, the present disclosure is not limited to this configuration, but the characteristic information may be corrected based on the change in the humidity, for example.

In addition, in the present embodiment, the measurement process is performed each time the temperature detected by the temperature sensor 90 changes by more than or equal to a certain level. However, the present disclosure is not limited to this configuration, but the measurement process may be performed without fail before the transfer process for the first surface of the sheet is performed.

In addition, in the present embodiment, the total current detecting portion 85 is used. However, the present disclosure is not limited to this configuration, but a configuration where the output currents of the power sources 81 to 84 are detected concurrently and individually may be adopted.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a plurality of image carrying members;

an intermediate transfer member to which a toner image formed on a surface of the plurality of image carrying members is primarily transferred;

a plurality of primary transfer members disposed to face the plurality of image carrying members across the intermediate transfer member and configured to primarily transfer the toner image from the plurality of image carrying members to the intermediate transfer member;

a characteristic measuring portion configured to measure current-voltage characteristics of each of the plurality of primary transfer members before a toner image for a first surface of a sheet is primarily transferred;

a characteristic information storage portion configured to store characteristic information that indicates the current-voltage characteristics measured by the characteristic measuring portion;

a first transfer voltage determining portion configured to determine, based on a predetermined first target current value and the characteristic information, a first transfer voltage that is applied to the plurality of primary transfer members when the toner image for the first surface of the sheet is primarily transferred;

a second transfer voltage determining portion configured to determine, based on a predetermined second target current value and the characteristic information that was used when the first transfer voltage was determined, a second transfer voltage that is applied to the plurality of primary transfer members when a toner image for a second surface of the sheet is primarily transferred, the second target current value being smaller than the first target current value;

a voltage control portion configured to apply the first transfer voltage to the plurality of primary transfer members by a constant-voltage method when the toner image for the first surface of the sheet is primarily transferred, and apply the second transfer voltage to the plurality of primary transfer members by the constant-voltage method when the toner image for the second surface of the sheet is primarily transferred;

a plurality of power sources configured to apply voltages respectively and individually to the plurality of primary transfer members; and a total current detecting portion configured to detect a total current by totaling output currents of the plurality of power sources, wherein the characteristic measuring portion measures the current-voltage characteristics of each of the plurality of primary transfer members in sequence based on the total current detected by the total current detecting portion when output voltages of the plurality of power sources are changed in a predetermined pattern.

2. The image forming apparatus according to claim 1, wherein when a predetermined measurement condition is satisfied, the characteristic measuring portion measures the current-voltage characteristics of each of the plurality of primary transfer members before the toner image for the first surface of the sheet is primarily transferred.

3. The image forming apparatus according to claim 2, wherein the measurement condition is that an ambient temperature of the intermediate transfer member has changed by more than or equal to a certain level since a last generation of the characteristic information.

4. The image forming apparatus according to claim 1, further comprising:

a sensor configured to detect a temperature or a humidity, wherein the second transfer voltage determining portion is configured to correct the characteristic information that was used when the first transfer voltage was determined, based on a detection result of the sensor, and determine the second transfer voltage based on the characteristic information after correction and the second target current value.

5. The image forming apparatus according to claim 1, wherein the characteristic measuring portion measures the current-voltage characteristics of each of the plurality of primary transfer members based on currents that are detected when a plurality of different voltages are applied to each primary transfer member in sequence by the constant voltage method.

6. The image forming apparatus according to claim 1, wherein the intermediate transfer member contains an ion-conductive material, the plurality of primary transfer members contain conductive carbon, and a resistance value of the intermediate transfer member is larger than a resistance value of the plurality of primary transfer members.

* * * * *